United States Patent [19]

Piccoli

[11] Patent Number: 5,041,705

[45] Date of Patent: Aug. 20, 1991

[54] CABLE-ACTUATED EMERGENCY STOP SWITCH

[75] Inventor: Jean-Luc Piccoli, Angouleme, France

[73] Assignee: LA Telemecanique Electrique, Nanterre, France

[21] Appl. No.: 326,503

[22] Filed: Mar. 20, 1989

[30] Foreign Application Priority Data

Mar. 25, 1988 [FR] France ..... 88 03961

[51] Int. Cl.[5] ..... H01H 17/00; H01H 35/00

[52] U.S. Cl. ..... 200/52 R; 200/543

[58] Field of Search ..... 200/17 R, 18, 43.07, 200/43.8, 43, 43.13, 52 R, 502, 537, 543-546

[56] References Cited

U.S. PATENT DOCUMENTS 4,458,122 7/1984 Knight ..... 200/545 X

FOREIGN PATENT DOCUMENTS 0089863 9/1983 European Pat. Off. .

2810745 6/1979 Fed. Rep. of Germany .

2169142 7/1986 United Kingdom .

*Primary Examiner*—J. R. Scott

*Attorney, Agent, or Firm*—Young & Thompson

[57] ABSTRACT

A piston operated by a cable stretched out within hand reach along a dangerous zone actuates a tappet whose movements are transmitted to a slider. The slider in turn compresses a spring until in a first phase, before any switch actuation, a pawl engages a groove in the slider. This prevents return of the tappet to its rest position, whereby any attempt to simulate a machine breakdown by fraudulent actuation of the device leaves a trace in the device even before effective switch actuation has occurred. In a second phase the force of the spring exceeds the force necessary to retract locking pins of a striker which is therefore released abruptly to operate the switch. To restore the device to its standby state, a lock plug carrying a cam adapted to release the pawl from the groove in the slider is rotated by means of a key.

4 Claims, 3 Drawing Sheets

FIG_2
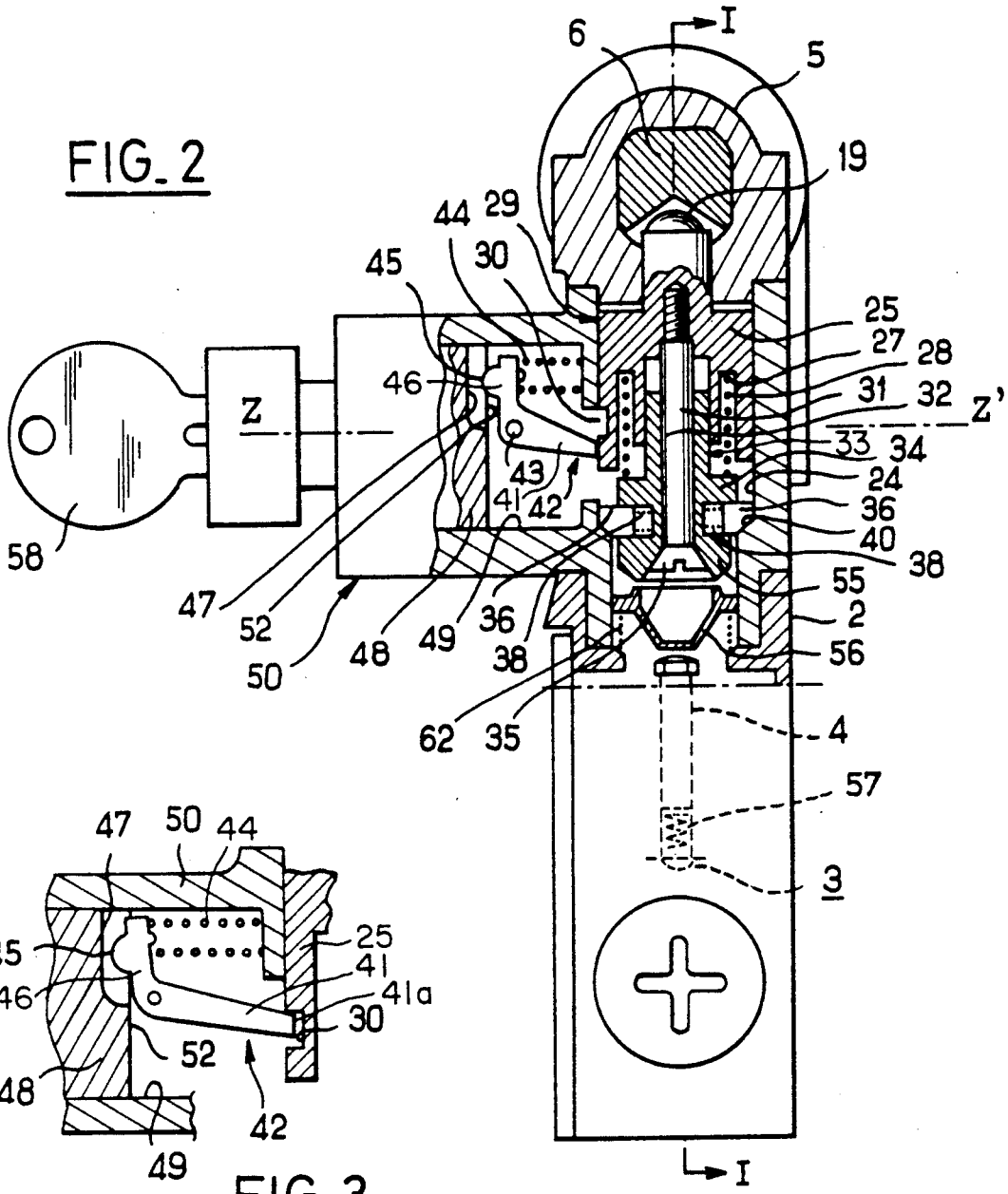
FIG_3
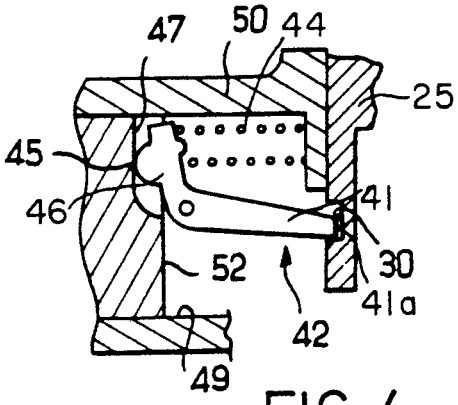
FIG_4
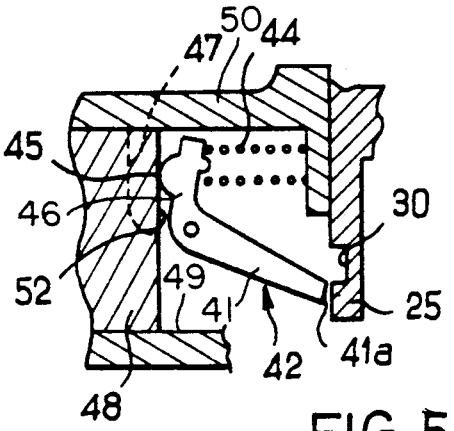
FIG_5

CABLE-ACTUATED EMERGENCY STOP SWITCH

This invention relates to a cable-actuated emergency stop device.

It relates more particularly to a cable-actuated emergency stop device comprising: a switch and associated actuating element; resilient sliding means adapted to be associated with one end of a cable stretched out in the zone to be protected, the last-mentioned means being formed with a recess having two inclined surfaces; a tappet movable transversely to the sliding means and normally received between the two inclined surfaces; transmission means disposed between the tappet and the switch-actuating element to move the switch into an operative state when the tappet is in an operative position; latching means for retaining the switch in its operative state when the tappet is in its operative position; and resetting means for selectively releasing the latching means.

BACKGROUND OF THE INVENTION

The cable of a device of this kind is stretched out along a dangerous installation so that the same can be stopped from anywhere along the cable, for example, by the cable being pulled up or down. It is generally desired that such devices, after an actuation, remain locked in an actuated state rather than recovering their normal condition. This prevents undetectable malicious actuation for simulating a breakdown in the installation. As a rule, therefore, the resetting means can be operated only by introducing a key into an appropriate lock.

However, it has been found that some commercially available equipment is not satisfactorily fraud-proof.

SUMMARY OF THE INVENTION

According to a first aspect of the invention, the emergency stop device is distinguished in that the transmission means comprise a transmision member with which the latching means co-operate and which is movable between a normal position, in which the tappet is in its normal position and the switch is urged in a first state, and an operative position, in which the switch is in its operative state, the transmission member passing through an intermediate position in which the switch retains whichever state it is in whereas the latching means inhibit the return of the transmission member to its normal position.

The latching means have therefore operated before there has been an irreversible change of state of the switch. There is therefore absolutely no doubt that any stoppage of the installation by the device will call for a resetting. It is completely impossible to disturb the operation of the installation by stealth.

Also, the cable, which is tensioned by its spring, may resonate with inputs of energy such as draughts. Substantial oscillation of the cable may stop the installation. The invention limits this risk, because the first oscillations entail latching of the transmission member before stopping the installation. The oscillation parameters of the cable are therefore modified since the transmission members are immobilized. This alters the resonant frequency and thus tends to limit the amplitude of cable oscillations.

According to a second aspect of the invention, the latching means are distinguished in that the transmission means comprise a transmission spring between the tappet and quick-acting threshold means movable between a standby position and a position for operating the switch, the threshold force being less than the force developed by the transmission spring when the tappet is near its operative position and the threshold means are in their standby position.

This second aspect of the invention is based on the same inventive concept as the first aspect whereby the switch is effectively operated only after an initial travel of the tappet, such travel being used to create conditions making the operation of the switch or latching irreversible. In the second aspect the conditions of irreversibility are compression of the transmission spring which triggers operation of the switch abruptly and uncontrollably.

Latching can be effected on the tappet or on a transmission member actuated thereby, as in the first aspect of the invention, or directly on the threshold means or on a transmission member connected thereto.

Other features and advantages of the invention will become apparent from the following description.

BRIEF DESCRIPTION OF THE DRAWINGS

In the accompanying exemplary and non-limitative drawings:

FIG. 2 is a view of the device partly in section along line II—II of FIG. 1;

FIGS. 3-5 are partial views showing the pawl in three different operating positions;

DESCRIPTION OF PREFERRED EMBODIMENTS

Figure 1:
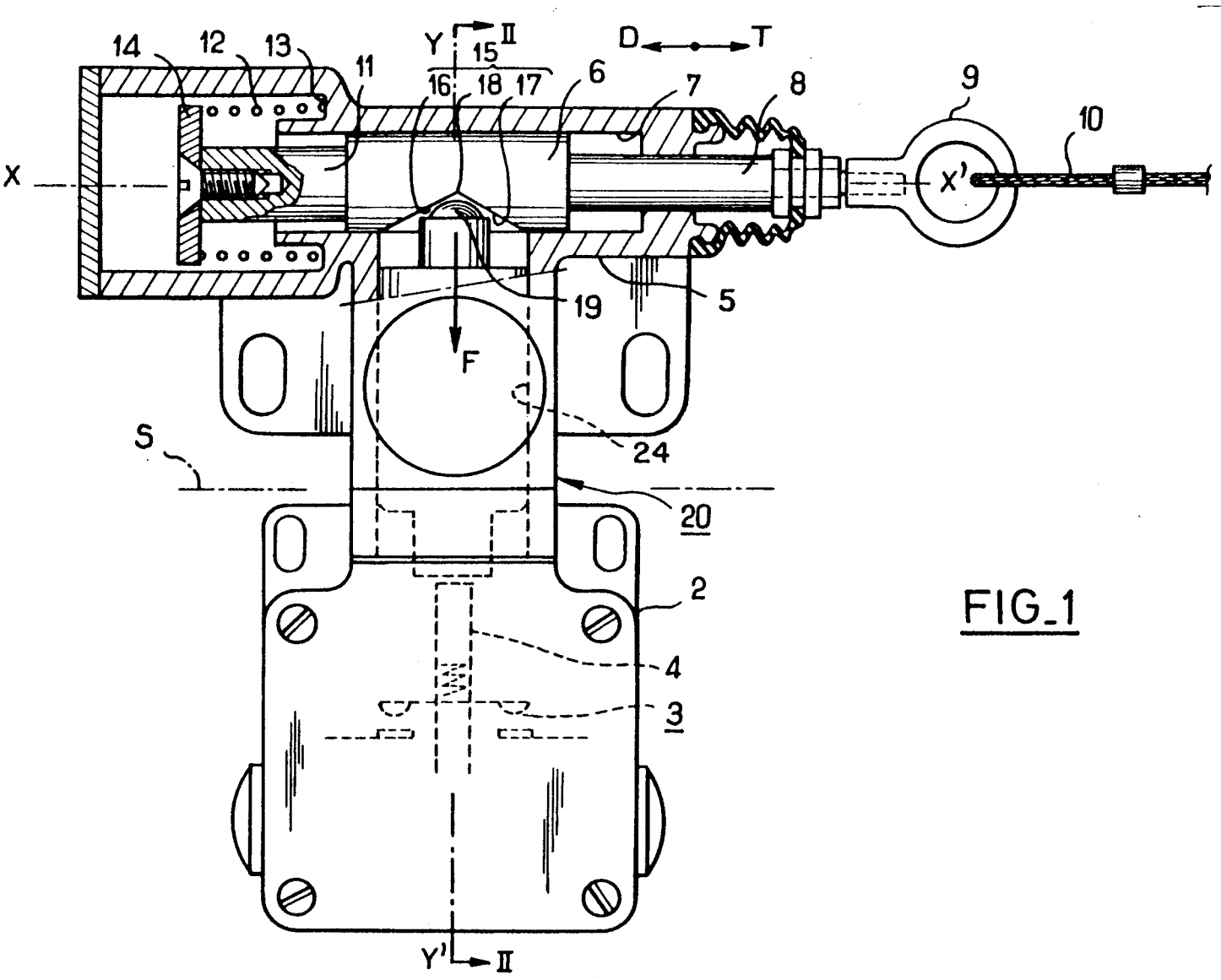
FIG. 1 is an elevation view of the device, with part of the view being a section along line I of FIG. 2.

In the example shown in FIG. 1 the device according to the invention comprises in a first box 2 a switch 3 having an actuating rod 4 movable along an axis Y—Y'. A second box 5 is secured to the first box 2 along a plane S and is formed with an internal recess 7 in which a slider or piston 6 slides along an axis X—X' perpendicular to the axis Y—Y'.

A first end 8 of the piston 6 projects outside the recess 7 and comprises, for example, a ring 9 adapted to receive a loop of a cable 10 which also extends substantially along the axis X—X'.

A compression spring 12 disposed between a bearing surface 13 of the box 5 and a collar 14 rigidly secured to a second end 11 of the piston 6 biases the piston 6 in the direction corresponding to tensioning of the cable 10.

When the cable has been appropriately tensioned by means which are not shown, a lateral recess 15 in the piston, defined by two opposite inclined surfaces 16, 17, has its deepest position 18 disposed on the axis Y—Y'. An actuating tappet 19 movable along the axis Y—Y' so projects into the recess 15 as to be slidingly expelled from the recess 7 along axis YY' by one or other of the inclined surfaces 16 or 17 when the piston 6 moves in either of the directions indicated by arrows D and T.

The tappet 19 forms part of a latchable and fraud-proof transmission device 20 interposed between the piston 6 and the switch-actuating rod 4.

Referring to FIG. 2, the tappet 19 is disposed at the end of a cylindrical slider 25 guided in a bore 24 having the same axis Y—Y' as the box 5. The outer surface 29 of the slider 25 is formed with a groove 30.

A rod 31 is secured axially to the slider 25 on the side thereof remote from the tappet 19 and is slidable in a bore 32 of a striker 33. A compression spring 28 is interposed between a collar 34 of the striker 33 and an annular groove 27 in the slider 25. When in its normal position the striker 33 bears on head 35 of the rod 31 because of some initial compression of the spring 28. Retractable pins 36 subject to the transverse forces of two compression springs 38 are disposed in lateral recesses in the striker 33.

The rod 31 is of a length such that, with the tappet 19 in its normal position, the striker 33 is in a standby position which can be seen in FIG. 2 and in which the pins 36 are substantially in engagement with a conical edge 40 of the bore 24. Also, the groove 30 is separated axially from one end 41*a* of an arm 41 of a pivoting bolt or pawl 42 adapted to pivot around a pivot pin 43. A compression spring 44 which acts on a second arm 46 of the pawl 42 urges the same in the direction in which its end 41*a* tends to move towards the axis Y—Y' and towards the tappet 19. Consequently, when the tappet 19 is in its normal position the spring 44 urges the pawl end 41*a* into engagement with the outside surface 29 of the slider 25. The second arm 46 of the pawl 42 has on its side remote from the spring 44 a protuberance 45 facing a camming surface 52 disposed at the end of a lock plug 48 rotatably mounted in a second bore 49 in a prolongation 50 of the box 5. The axis Z—Z' of the bore 49 is perpendicular to the axes X—X' and Y—Y'.

The lock plug 48 belongs to a resetting means and is of the type operated by a key 58. When the resetting means is in its normal position, the protuberance 45 is disposed opposite a recessed zone 47 of the camming surface 52.

An annular end 55 of the striker 33 is disposed very near an intermediate bell-shaped slider 56 interposed between the striker 33 and the switch-actuating rod 4. A compression spring biases the intermediate slider 56 towards the striker 33. The intermediate slider 56 is a low-cost way of transmitting the movement of the striker 33 to the rod 4 despite the presence of the rod 31 and of the head 35 thereof.

Operation is as follows:

The piston 6, when it moves in the direction T or D because of a pull on the cable 10 or because of a breakage thereof, respectively, transmits a movement in the direction F to the slider 25. The slider 25 thereby compresses the spring 28 since the striker 33 is retained axially by the pins 36 bearing on the conical edge 40.

When the slider 25 has made an initial travel, the pawl end 41*a* is moved into the groove 30 by the spring 44, as shown in FIG. 3. The slider 25 continues its movement, thereby increasing compression of the spring 28 (and recompressing of the spring 44 since the slider 25 moves the pawl 42) until the force exerted by the spring 28 exceeds the threshold force which the striker 33 can withstand. This threshold is determined by the axial force necessary for retracting the pins 36 into their recess. After such retraction the striker 33, being released, actuates the intermediate slider 56 and, therefore, the switch-actuating rod 4 instantaneously and abruptly, while the spring 28 expands.

When the piston 6 returns to its neutral position (shown in FIG. 1), the spring 28 expands and thrusts back the slider 25, which in turn rotates the pawl 42. When the protuberance 45 engages the recessed zone 47 of the cam 52 the pawl 42 is prevented from further rotation and therefore locks the slider 25 in an intermediate position in which the compressive force of the spring 28 is greater than that of the opposing springs 57 of the switch 3 and 62 of the slider 56.

Consequently, although the piston 6 has returned to its neutral position, the switch 3 remains operated even in response to a very brief actuation of the cable 10. Also, since the pawl 42 engages the groove 30 before the pins 36 have retracted, the slider 25 was "trapped" by the pawl 42 even before the irreversible phase of actuation of the switch 3 began. If the movement of the piston 6 from its neutral position is insufficient for the slider 25 to move beyond its intermediate position in which the pawl 42 has just engaged the groove 30, the switch 3 is not operated. In other words, when the slider 25 is in its intermediate position the switch retains whatever state it is in.

To reset the device—i.e. release the slider 25 from the bolt or pawl 42—the plug 48 is so rotated by the key 58 around the axis Z—Z' that the cam surface 52 (FIG. 5) expels the protuberance 45 in the direction corresponding to compression of the spring 44. The pawl 42 is therefore rotated in the direction in which the pawl end 41*a* moves out of the groove 30. The slider 25 is then returned to its inoperative position first by the spring 28 and then, when the striker 33 is bearing on the head 35 of the rod 31, by the return springs 57, 62 moving back towards the axis X—X' the system formed by the striker 33 and slider 25. The switch 3 therefore returns to its normal state.

Figure 6:
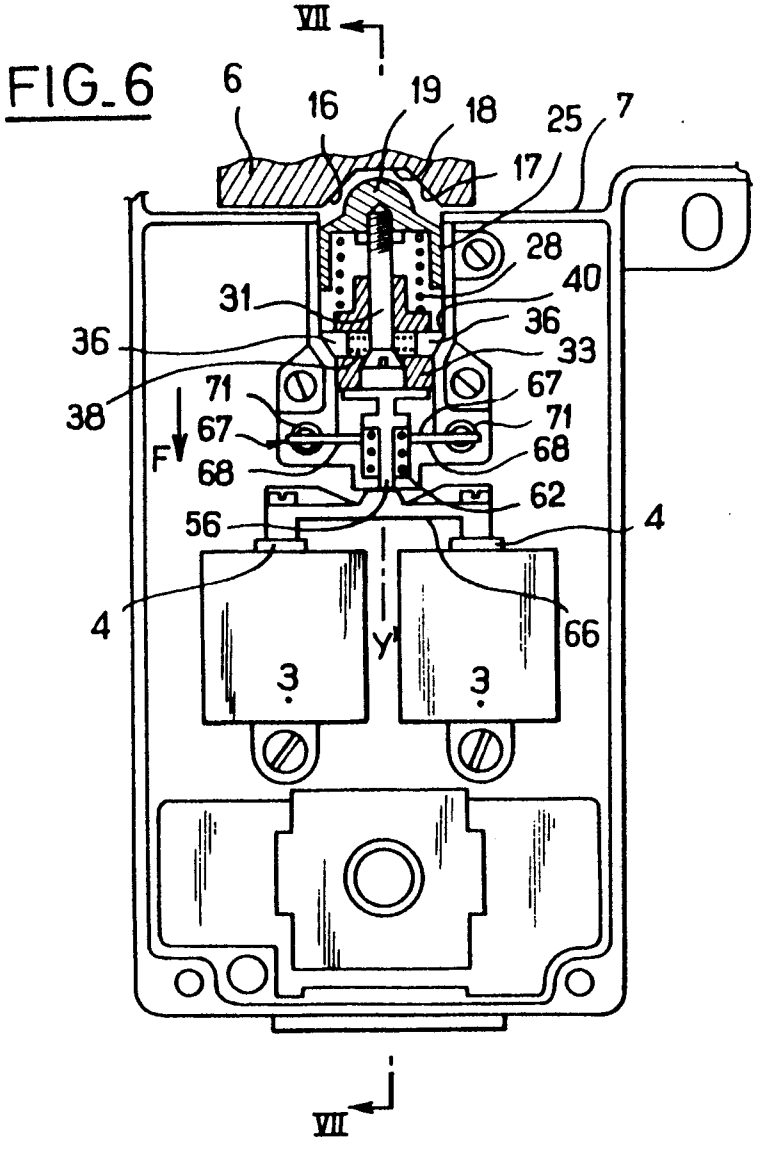
FIG. 6 is a partial view of a second embodiment of the invention in an axial section along line VI—VI of FIG. 7.

The embodiment shown in FIGS. 6 and 7 will be described only in respect of its differences from the previous embodiment.

In this second embodiment the latching means cooperate not with the slider 25 but with the intermediate slider 56 which, instead of acting directly on the actuating rod 4 of a single switch 3, acts simultaneously on the actuating rods 4 of two switches 3 by way of a stirrup 66.

The latching means comprise a latching slider 67 arranged to slide in the box in a direction transverse to the axis Y—Y'. The slider 67 has two arms 68, which extend on either side of the intermediate slider 56, and a central part 69 urged towards the axis Y—Y' by two compression springs 71.

When the intermediate slider 56 is in the position in which the switches 3 have been operated, it presents opposite the latching slider 67 a region reduced by a shoulder 72. When the slider 56 moves in the direction for operating the switches 3, the springs 71 move the latching slider 67 above the shoulder 72 once the same has passed beyond the slider 67. It is then impossible for the slider 56 and, therefore, for the switches 3 to return to their normal positions except by means of the resetting device.

Figure 7:
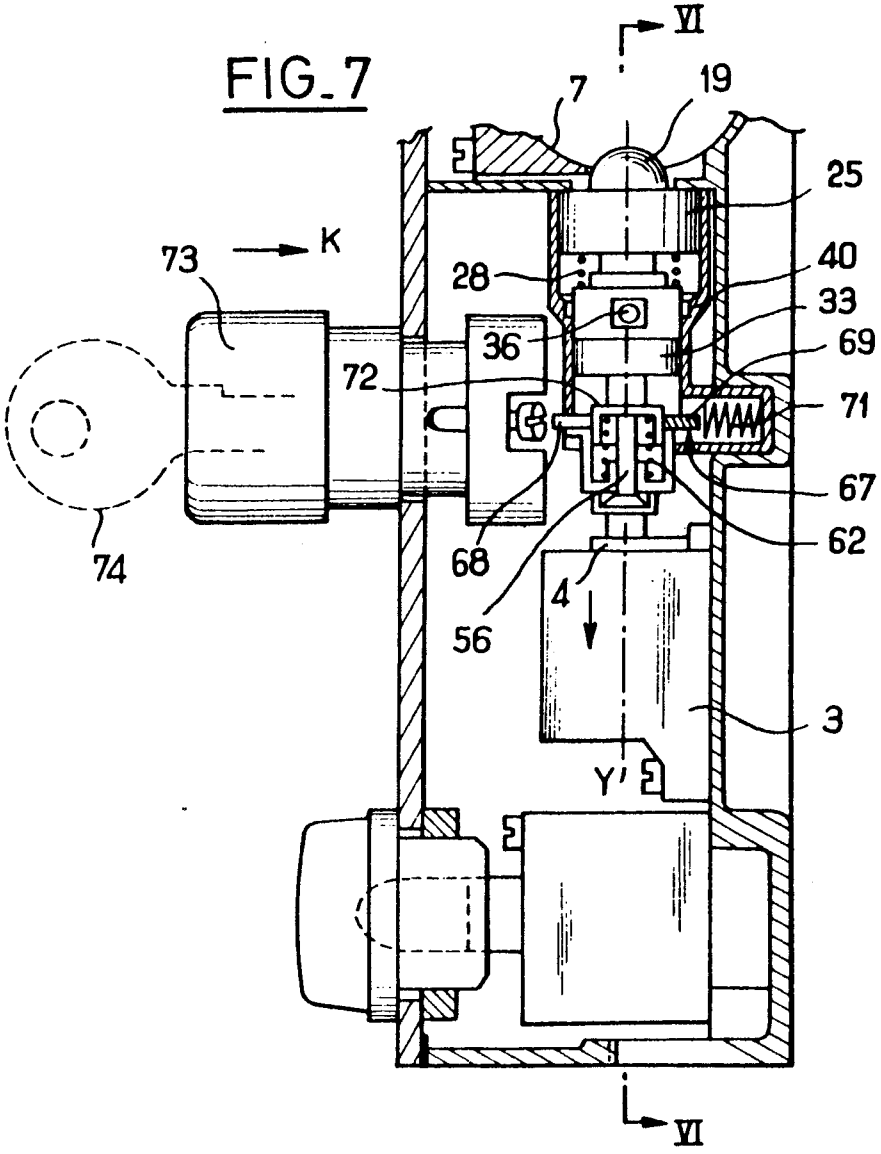
FIG. 7 is a partial view in section along line VII—VII of FIG. 6.

As shown by FIG. 7 the resetting device comprises a push button 73 which after release by means of a key 74 can be depressed towards the inside of the box so that an operative surface of the button presses on the ends of the arms 68 in the direction corresponding to compression of the springs 71. This enables return springs of the switches 3 and the return spring 62 for the slider 56 to return the striker 33 to its standby position and to return the slider 25 to its standby position in which the tappet 19 projects into the recess 7.

However, this resetting is possible only if the piston has meanwhile returned to its neutral position, otherwise the spring 28 would prevent the striker 33 from rising.

I claim:

1. A cable-controlled electrical safety switch device, comprising:

a casing;

a switch connected to said casing and having an actuator element;

a movable assembly disposed within said casing and having a portion adapted to be connected to a cable, said movable assembly being mounted for movement within said casing in a first direction and a second direction opposite said first direction, said movable assembly comprising a spring supported within said casing and resisting movement of said movable assembly in said first direction, said movable assembly further comprising a cam element having laterally thereof a recess defining two cam flanks;

a tappet mounted in said casing for movement along a third direction of movement transverse to said first and second directions, between a normal position in which a portion of said tappet protrudes into said recess and an actuated position in which said portion of said tappet is outside the recess;

biasing mans resisting movement of said tappet from said normal position towards said actuated position along said third direction, said tappet being displaced from the normal position to the actuated position by a first said cam-flank when the movable assembly is displaced by the spring along the second direction of movement and by a second said cam-flank when the cam element is displaced along the first direction of movement against the force of the spring; and transmission means disposed between said tappet and said actuator element to move the switch into an actuated state when the tappet is in the actuated position, said transmission means comprising a transmission spring operatively mounted between said tappet and a quick-acting force-threshold means movable from a standby position to a switch-actuating position when subjected to a threshold force by the transmission spring.

2. The device according to claim 1, further comprising:

latching means for preventing the tappet from returning to its normal position, after the force-threshold means moves from the standby position towards the switch actuating position; and resetting means for selectively disabling the latching means.

3. The device according to claim 2, wherein the latching means selectively lock the force-threshold means against movement towards the standby position when the threshold means has moved past a predetermined position from the standby position towards the switch-actuating position.

4. The device according to claim 2, further comprising means for so limiting separation between said tappet and said force-threshold means that, upon disabling of the latching means by the resetting means and production by the transmission spring of a maximum separation between the tappet and the force-threshold means, return means move the force-threshold means to its standby position and the tappet to its normal position, whereby the switch returns to its normal state.

* * * * *